US006158400A

United States Patent [19]

Collie et al.

[11] Patent Number: 6,158,400

[45] Date of Patent: Dec. 12, 2000

[54] INTERNAL COMBUSTION ENGINE WITH HIGH PERFORMANCE COOLING SYSTEM

[75] Inventors: Curtis Bevan Collie, Dearborn Heights; Michael Joseph Schrader, Belleville, both of Mich.

[73] Assignee: Ford Global Technologies, Inc., Dearborn, Mich.

[21] Appl. No.: 09/227,845

[22] Filed: Jan. 11, 1999

[51] Int. Cl.[7] ..... F02F 1/36

[52] U.S. Cl. ..... 123/41.82 R; 123/41.79; 29/888.061

[58] Field of Search ..... 123/41.72, 41.74, 123/41.79, 41.82 R; 29/888.06, 888.061

[56] References Cited

U.S. PATENT DOCUMENTS

| | | | |
|---|---|---|---|
| 2,331,554 | 10/1943 | Irgens | 123/41.72 |
| 2,609,801 | 9/1952 | Kiekhaefer | 123/41.74 |
| 4,083,333 | 4/1978 | Rudert et al. | 123/41.82 R |
| 4,377,990 | 3/1983 | Seidl | 123/41.74 |
| 4,699,092 | 10/1987 | Ruf et al. . | |
| 4,714,058 | 12/1987 | Oda et al. . | |
| 4,730,579 | 3/1988 | Yamada et al. | 123/41.74 |
| 5,048,468 | 9/1991 | Broughton et al. | 123/41.74 |
| 5,076,217 | 12/1991 | Clough | 123/41.74 |
| 5,615,641 | 4/1997 | Koch et al. | 123/41.82 R |

FOREIGN PATENT DOCUMENTS

| | | | |
|---|---|---|---|
| 3601383 | 7/1987 | Germany | 123/41.82 R |
| 63-72465 | 2/1988 | Japan . | |
| 3-99767 | 4/1991 | Japan . | |
| 3-264720 | 11/1991 | Japan | 123/41.79 |
| 6-304739 | 11/1994 | Japan . | |
| 6-320252 | 11/1994 | Japan . | |

*Primary Examiner*—Noah P. Kamen
*Attorney, Agent, or Firm*—Jerome R. Droulliard

[57] ABSTRACT

An internal combustion engine includes precision cooling passages preformed as tubes which are cast in place during fabrication of the engine's cylinder block and cylinder head.

17 Claims, 3 Drawing Sheets

INTERNAL COMBUSTION ENGINE WITH HIGH PERFORMANCE COOLING SYSTEM

FIELD OF THE INVENTION

The present invention relates to a liquid cooled internal combustion engine having coolant passages cast into the cylinder block and cylinder head.

DISCLOSURE INFORMATION

Liquid cooling of internal combustion engines may be conducted with greater efficiency if the flow rates and flow channel sizes can be precisely controlled. For example, in many engines it is desirable to run coolant through passages at fairly high speeds, say in excess of 5 meters per second, so as to increase the coefficient of heat transfer. Unfortunately, it is not possible to produce small diameter coolant passages using conventional techniques. In point of fact, sand cores commonly used with casting processes lack sufficient strength to allow small passages to be cored through cylinder heads and cylinder blocks. As an alternative, it is known to drill coolant passages, but the time required for such drilling renders this option unattractive for mass production. For example, in one engine machining line used by Ford Motor Company, the station time available per machine is less than one-half minute and drilling passages of any length would prohibitively add time, and therefore, cost, to the engine manufacturing process.

The present invention solves the problem of providing precise, smaller diameter coolant passages without requiring excessive cost in terms of either materials or manufacturing.

SUMMARY OF THE INVENTION

A reciprocating internal combustion engine includes a cylinder block having a plurality of cylinders located therein and a plurality of pistons slidingly contained within the cylinders. The crankshaft, having a center line, is attached to the pistons by means of a plurality of connecting rods. A cylinder head mounted to the cylinder block closes one end of the cylinders. The cylinder head is formed by casting, as is the cylinder block. A coolant pump circulates liquid coolant through the engine. A plurality of coolant passages are formed within the cylinder head and cylinder block. At least one of the passages comprises a tube which is preformed and cast in place during casting of the cylinder head or cylinder block.

The coolant passages in the cylinder head extend the length of the cylinder head in a direction which is generally parallel to the center line of the crankshaft. At least one passage is positioned generally between a row of intake valves and a central plane containing the center lines of the cylinders. A second passage is positioned generally between the central plane and a row of exhaust valves located within the cylinder head. A third passage may be positioned between the row of exhaust valves in an outermost part of the cylinder head. The passages may preferably comprise a plurality of arcuate segments which permit contouring about the location of spark plugs, or fuel injectors, or other architectural features located within the cylinder head such as intake ports, exhaust ports, and valve train components. Finally, the passages may extend not only longitudinally in the general direction of the center line of the crankshaft, but also may include secondary passages extending generally transversely across the cylinder head and connecting with the passages extending longitudinally or parallel to the crankshaft centerline.

It is an advantage of the present invention that a cooling system may be produced with relatively smaller diameter passages so as to allow higher flow velocities and higher heat transfer coefficients while at the same time not unduly increasing the pressure drop through the cooling passages. This results from the fact that the preform used to form passages according to the present invention will generally be much smoother and offer much less flow inhibition than will a relatively rougher passage formed with a sand core.

It is a further advantage of the present invention that an engine having this invention may be operated to warm up on a much quicker basis, thereby minimizing undesirable engine exhaust emissions.

Other advantages as well as objects and features of the present invention will become apparent to the reader of this specification.

DETAILED DESCRIPTION AND BEST MODE

Figure 1:
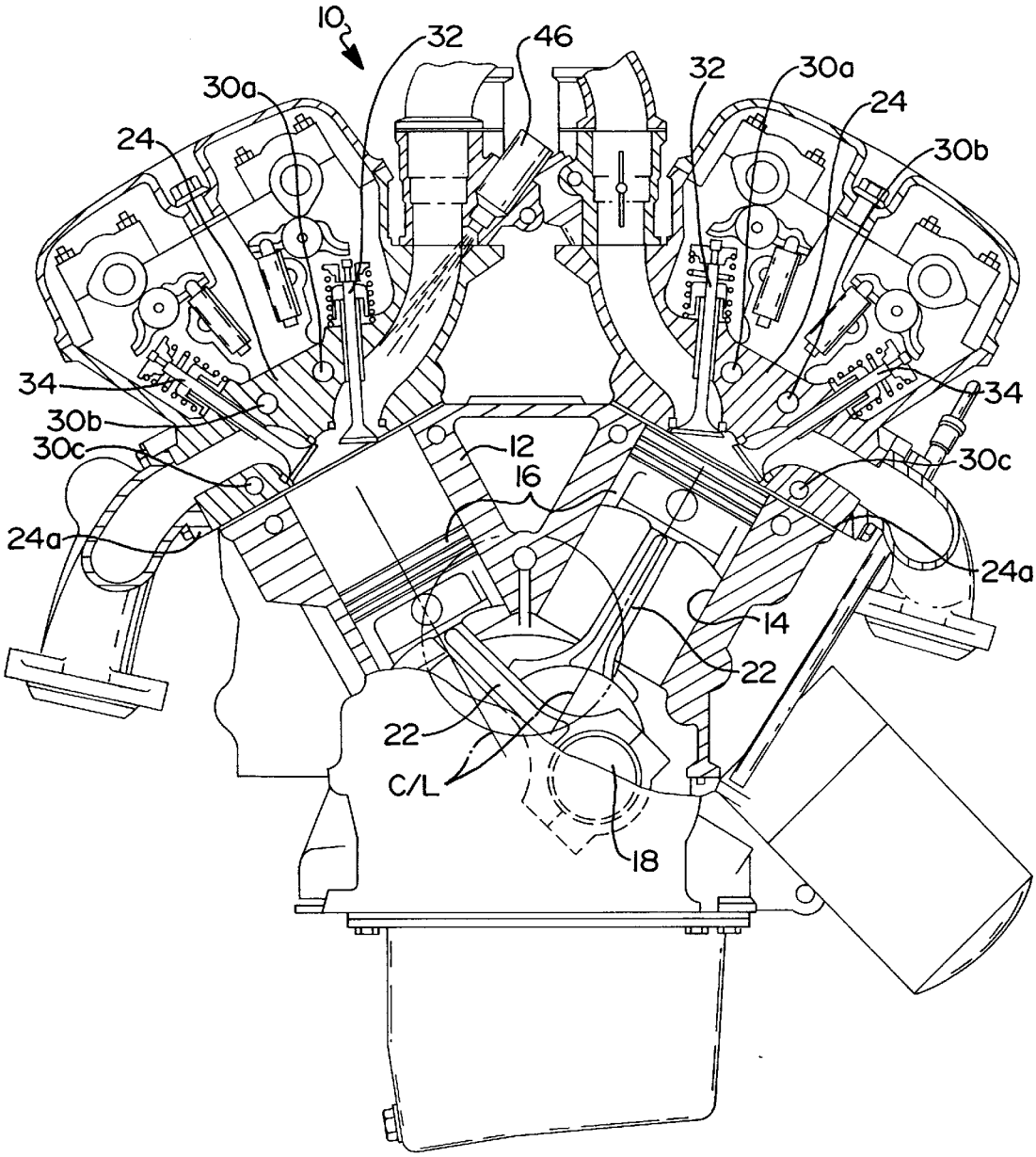
FIG. 1 is a sectional view of an engine according to the present invention.
Figure 2:
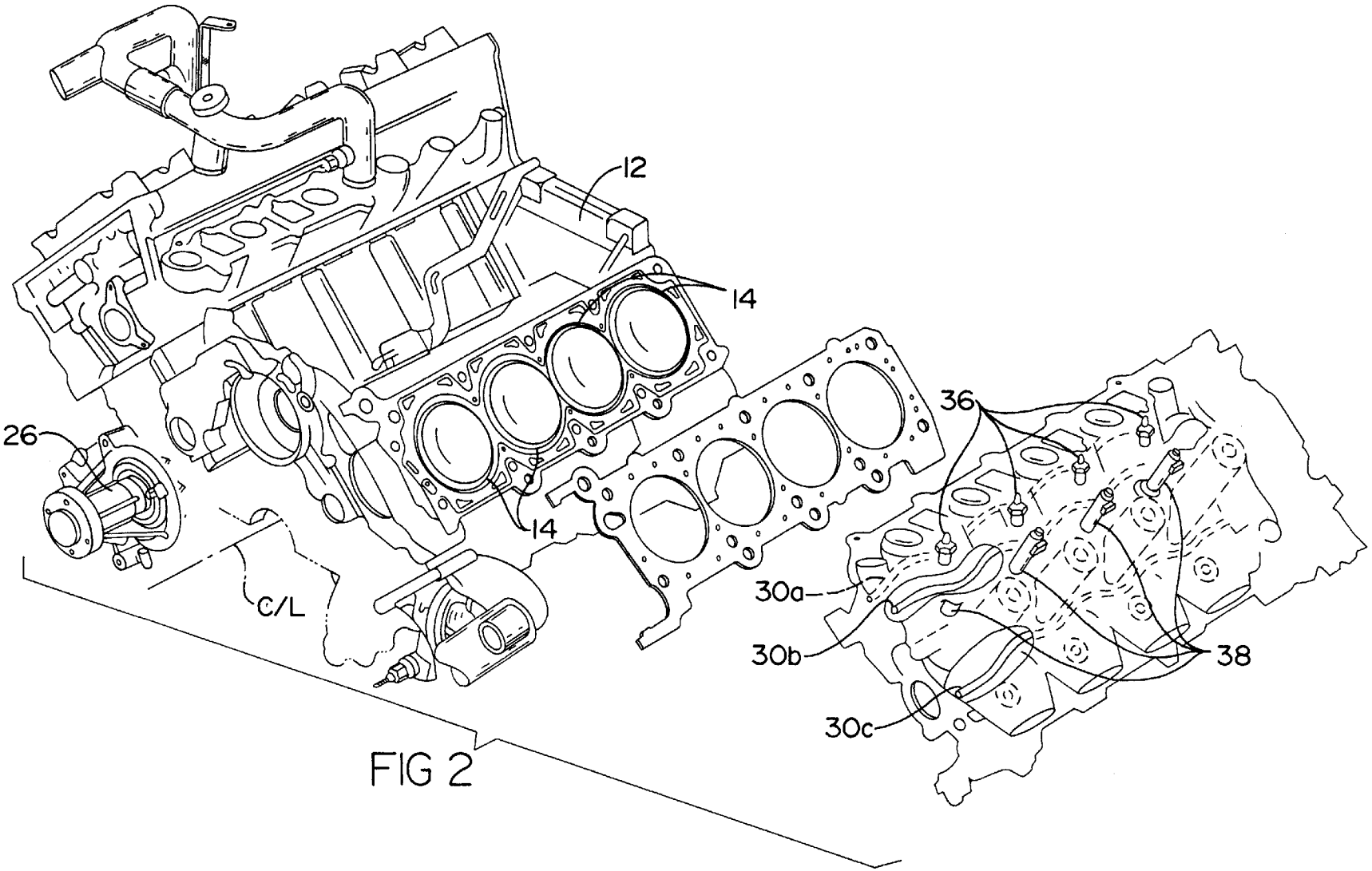
FIG. 2 is a exploded perspective view of an engine according to the present invention.

As shown in FIG. 1, engine 10 has block 12 with a plurality of cylinders 14 formed therein. Piston 16 is slidably contained within cylinders 14. Piston 16 is connected with crankshaft 18 by means of connecting rod 22. Cylinder heads 24 mounted to cylinder block 12 close one end of cylinders 14. The bottom end of connecting rods 22 are mounted to crankshaft 18 which has a center line (C/L), as shown in FIG. 2. A plurality of coolant passages 30*a*–30*c* extend through cylinder head 24. Passage 30*a* extends for the length of cylinder head 24 in a direction which is generally parallel to the center line of crankshaft 18. Passages 30*a,* which are shown in both of the cylinder heads of FIG. 1, are located between a row of intake valves 32 and a central plane containing the center lines of cylinders 14.

A second passage 30*b,* located within cylinder head 24, is located between the central plane defined as containing the center lines of cylinders 14 and a row of exhaust valves 34.

A third cooling passage 30*c* is located between a row of exhaust valves 34 and an outermost portion 24*a* of cylinder head 24.

Passage 30*a* need not be straight. As shown in FIG. 2, passage 30*a* may be contoured about a plurality of spark plugs 36 or a plurality of fuel injectors 38. Because passage 30*a* is preferably formed by means of a tubular preform, which is fixtured in a mold and cast in place within cylinder head 24, passage 30*a* may have the illustrated shape which is a plurality of arcuate segments. The arcuate segments shown for passage 30*a,* and passages 30*b* and 30*c* for that matter in FIG. 2, offers the ability to provide a relatively smaller diameter, smooth passage, with a high heat transfer coefficient as well as the ability to manufacture the passage because a sand core need not be used.

A water valve (not shown) may be used for reducing or eliminating the flow of coolant to passage 30*a* while the engine is being warmed up. In this manner, engine exhaust emissions may be reduced because the engine's operating temperature will come up quickly, as will the operating temperature of a catalytic exhaust treatment device (not shown) which is typically used with automotive vehicles.

Although FIG. 1 shows a port fuel injector 46, it is clear from FIG. 2, which shows direct fuel injectors, that a cooling system according to the present invention may be used with engines either having conventional port fuel injection or conventional direct injection of gasoline or other liquid or gaseous fuels in a combustion chamber of an engine.

Figure 3:
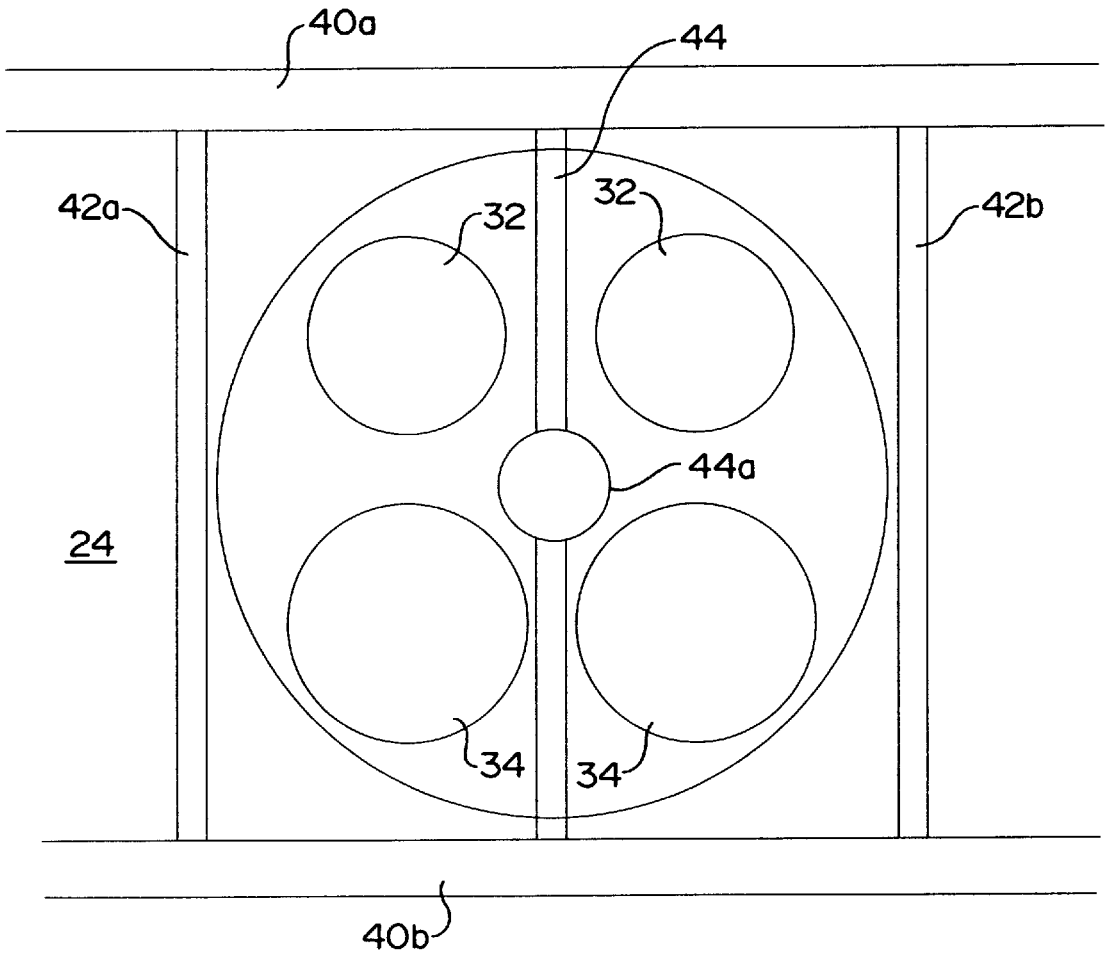
FIG. 3 is a schematic plan view of a portion of a cylinder head of an engine according to the present invention.

FIG. 3 illustrates an engine in which a plurality of coolant passages 40*a* and 40*b* formed within cylinder head 24 comprise generally tubular preforms which are cast in place during casting of the cylinder head. Passages 40*a* and 40*b* generally extend parallel to the center line of crankshaft of the engine and are intersected by a plurality of passages 42*a* and 42*b*, and 44, which extend transversely across cylinder head 24 such that the first and second sets of passages are interconnected. An advantage of the system shown is that passages may be formed according to FIG. 3 without the necessity of either sand coring or drilling of castings.

While the invention has been shown and described in its preferred embodiments, it will be clear to those skilled in the arts to which it pertains that many changes and modifications may be made thereto without departing from the scope of the invention.

What is claimed is:

1. A reciprocating internal combustion engine, comprising:

a cylinder block having a plurality of cylinders located therein, with each of the cylinders having a centerline;

a plurality of pistons slidingly contained within said cylinders;

a crankshaft attached to said pistons by means of a plurality of connecting rods, with said crankshaft having a centerline;

a cylinder head mounted to said cylinder block for closing one end of said cylinders, with said cylinder head being formed by casting having an upper surface and a lower surface to be disposed adjacent said cylinder block;

a coolant pump for circulating liquid coolant through the engine; and a plurality of coolant passages formed within said cylinder head, with at least one of said passages comprising a tube cast in place during casting of the cylinder head between said upper surface and said lower surface.

2. An engine according to claim 1, wherein said at least one coolant passage extends for the length of the cylinder head in a direction which is generally parallel to the centerline of the crankshaft.

3. An engine according to claim 1, wherein said plurality of coolant passages comprise at least one passage extending for the length of the cylinder head in a direction which is generally parallel to the centerline of the crankshaft.

4. An engine according to claim 3, further comprising a valve for controlling the flow of coolant within said at least one passage.

5. An engine according to claim 1, where said plurality of coolant passages comprises a first passage positioned generally between a row of intake valves and a central plane containing the centerlines of the cylinders.

6. An engine according to claim 1, wherein said plurality of coolant passages extends generally parallel to the centerline of the crankshaft, with said coolant passages comprising a first passage positioned generally between a row of intake valves and a central plane containing the centerlines of the cylinder and a second passage positioned generally between said central plane and a row of exhaust valves located within the cylinder head.

7. An engine according to claim 6, further comprising a valve for controlling the flow of coolant within said first passage such that the volume of coolant flowing through the first passage will be reduced when the engine is operated at part throttle.

8. An engine according to claim 6, further comprising a valve for controlling the flow of coolant within said first passage such that the volume of coolant flowing through the first passage will be reduced when an operating temperature of the engine is below a predetermined threshold.

9. An engine according to claim 1, wherein said plurality of coolant passages comprises a first passage positioned generally between a row of intake valves and a central plane of the engine, a second passage positioned generally between said central plane and a row of exhaust valves located within the cylinder head, and a third passage positioned between said row of exhaust valves and an outermost part of the cylinder head.

10. An engine according to claim 9, further comprising a valve for controlling the flow of coolant within said first passage such that the volume of coolant flowing through the first passage will be reduced when an operating temperature of the engine is below a predetermined threshold.

11. An engine according to claim 9, further comprising a plurality of valves for controlling the flow of coolant within said first passage, said second passage, and said third passage.

12. An engine according to claim 1, wherein said at least one coolant passage extends the length of the cylinder block in a direction which is generally parallel to the centerline of the crankshaft, with said at least one cooling passage comprising a plurality of arcuate segments.

13. An engine according to claim 1, wherein said plurality of coolant passages comprises at least one passage extending for the length of the cylinder head in a direction which is generally parallel to the centerline of the crankshaft, with said at least one cooling passage being contoured about the locations of a plurality of sparkplugs mounted in the cylinder head.

14. An engine according to claim 1, wherein said plurality of coolant passages comprises at least one passage extending for the length of the cylinder head in a direction which is generally parallel to the centerline of the crankshaft, with said at least one cooling passage being contoured about the locations of a plurality of fuel injectors mounted in the cylinder head.

15. A reciprocating internal combustion engine, comprising:

a cylinder block having a plurality of cylinders located therein;

a plurality of pistons slidingly contained within said cylinders;

a crankshaft attached to said pistons by means of a plurality of connecting rods, with said crankshaft having a centerline;

a cylinder head mounted to said cylinder block for closing one end of said cylinders, with said cylinder head being formed by casting having an upper surface and a lower surface to be disposed adjacent said cylinder block;

a coolant pump for circulating liquid coolant through the engine; and a plurality of coolant passages formed within said cylinder head between said upper surface and said lower surface, with each of said passages comprising a generally tubular preform cast in place during casting of the cylinder head.

16. An engine according to claim 15, wherein said passages comprise a first plurality of passages extending the length of said cylinder head in a direction which is generally parallel to the centerline of the crankshaft and a second plurality of passages extending generally transversely across said cylinder head such that the first and second sets of passages are interconnected.

17. An engine according to claim 16, wherein said first plurality of passages comprises at least one passage having a plurality of arcuate segments.

* * * * *